US007393473B2

(12) United States Patent
Miyazawa et al.

(10) Patent No.: US 7,393,473 B2
(45) **Date of Patent: *Jul. 1, 2008**

(54) METHOD FOR PRODUCING A COMPOSITE PLATED PRODUCT

(75) Inventors: Hiroshi Miyazawa, Honjo (JP); Reki Yonezawa, Honjo (JP)

(73) Assignee: Dowa Mining Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/481,318

(22) Filed: Jul. 5, 2006

(65) Prior Publication Data

US 2007/0007497 A1 Jan. 11, 2007

(30) Foreign Application Priority Data

Jul. 5, 2005 (JP) ..... 2005-195678

(51) Int. Cl.
*H01B 1/00* (2006.01)
*H01B 1/12* (2006.01)

(52) U.S. Cl. ..... 252/500; 205/98; 205/125; 205/184; 205/238; 428/220; 428/367; 428/626; 502/101; 600/583

(58) Field of Classification Search ..... 252/500; 200/265; 205/238, 98, 125, 184; 428/626, 428/367, 220; 502/101; 600/583
See application file for complete search history.

(56) References Cited

U.S. PATENT DOCUMENTS 3,301,707 A * 1/1967 Loeb et al. ..... 428/220
3,550,247 A 12/1970 Evans et al.
3,580,821 A 5/1971 Todt et al.
3,865,705 A * 2/1975 Rieux et al. ..... 428/367
4,155,817 A * 5/1979 Fletcher et al. ..... 205/238
4,177,114 A * 12/1979 Suzuki et al. ..... 205/184
4,619,741 A * 10/1986 Minten et al. ..... 205/125
4,680,093 A * 7/1987 Morin ..... 428/626
5,139,642 A * 8/1992 Randolph et al. ..... 205/125
5,199,553 A * 4/1993 Shinohara et al. ..... 200/265
5,290,422 A 3/1994 Michelsen-Mohammadein
6,319,209 B1 * 11/2001 Kriz ..... 600/583
6,565,731 B1 * 5/2003 Couble et al. ..... 205/125
6,942,779 B2 * 9/2005 Belongia et al. ..... 205/98
7,220,693 B1 * 5/2007 Qi et al. ..... 502/101

FOREIGN PATENT DOCUMENTS

EP 1 609 888 12/2005
GB 1 534 429 12/1978

(Continued)

*Primary Examiner*—Mark Kopec
*Assistant Examiner*—Khanh T Nguyen
(74) *Attorney, Agent, or Firm*—Bachman & LaPointe, P.C.

(57) ABSTRACT

There is provided a composite plated product wherein a coating of a composite material containing carbon particles in a silver layer is formed on a substrate, the composite plated product having a large content of carbon and a large quantity of carbon particles on the surface thereof and having a low coefficient of friction and an excellent wear resistance. Carbon particles treated by an oxidation treatment and a silver matrix orientation adjusting agent are added to a silver plating solution for electroplating a substrate to adjust the orientation of a silver matrix to form a coating of a composite material, which contains the carbon particles in a silver layer, on the substrate.

2 Claims, 4 Drawing Sheets

FOREIGN PATENT DOCUMENTS

| | | | |
|---|---|---|---|
| GB | 2217347 | * | 10/1989 |
| JP | 62-250193 | * | 10/1987 |
| JP | 01-146215 | * | 6/1989 |
| JP | 3-253598 | | 11/1991 |
| JP | 05-193919 | * | 8/1993 |
| JP | 5-505853 | | 8/1993 |
| JP | 9-7445 | | 1/1997 |
| JP | 10-237349 | * | 9/1998 |

* cited by examiner

METHOD FOR PRODUCING A COMPOSITE PLATED PRODUCT

BACKGROUND OF THE INVENTION

1. Field of the Invention

The present invention generally relates to a composite plated product and a method for producing the same. More specifically, the invention relates to a composite plated product wherein a coating of a composite material containing carbon particles in a silver layer is formed on a substrate and which is used as a material of sliding contact parts such as switches and connectors.

2. Description of the Prior Art

Conventionally, as materials of sliding contact parts such as switches and connectors, there are used silver-plated products wherein a conductive material such as copper or a copper alloy is plated with silver in order to prevent oxidation of the conductive material due to heat in sliding processes.

However, there is a problem in that silver coatings are easily stripped by sliding since they are soft and easily wear and since they generally have a high coefficient of friction. In order to solve this problem, there is proposed a method for electroplating a conductive material with a composite material wherein graphite particles are dispersed in a silver matrix, in order to improve the wear resistance of the conductive material (see, e.g., Japanese Patent Laid-Open No. 9-7445). There is also proposed a method for producing a silver coating, which contains graphite particles, by means of a plating bath to which a wetting agent suitable for the dispersion of graphite particles is added (see, e.g., Japanese Patent Unexamined Publication No. 5-505853 (National Publication of Translated Version of PCT/DE91/00241)). Moreover, there is proposed a method for coating carbon particles with a metal oxide or the like by the sol-gel method to enhance the dispersibility of the carbon particles in a composite plating bath of silver and the carbon particles to increase the quantity of carbon particles in a composite coating (see, e.g., Japanese Patent Laid-Open No. 3-253598).

However, composite plated products produced by the methods disclosed in Japanese Patent Laid-Open No. 9-7445, Japanese Patent Unexamined Publication No. 5-505853 and Japanese Patent Laid-Open No. 3-253598 have a relatively high coefficient of friction and a relatively low wear resistance, so that there is a problem in that the composite plated products can not used as the materials of long-life contacts and terminals. Therefore, it is desired to provide a composite plated product which has a larger content of carbon and a larger quantity of carbon particles on the surface thereof than those of the composite plated products produced by the conventional methods and which has a better wear resistance than that of the composite plated products produced by the conventional methods.

SUMMARY OF THE INVENTION

It is therefore an object of the present invention to eliminate the aforementioned problems and to provide a composite plated product wherein a coating of a composite material containing carbon particles in a silver layer is formed on a substrate, the composite plated product having a large content of carbon and a large quantity of carbon particles on the surface thereof and having a low coefficient of friction and an excellent wear resistance, and a method for producing the same.

In order to accomplish the aforementioned and other objects, the inventors have diligently studied and found that it is possible to produce a composite plated product wherein a coating of a composite material containing carbon particles in a silver layer is formed on a substrate, the composite plated product having a large content of carbon and a large quantity of carbon particles on the surface thereof and having a low coefficient of friction and an excellent wear resistance, by electroplating a substrate in a silver plating solution to which carbon particles treated by an oxidation treatment and a silver matrix orientation adjusting agent are added. Thus, the inventors have made the present invention.

According one aspect of the present invention, there is provided a method for producing a composite plated product, the method comprising the steps of: preparing carbon particles and a silver matrix orientation adjusting agent which is an agent for adjusting the orientation of a silver matrix; treating the carbon particles by an oxidation treatment; adding the treated carbon particles and the silver matrix orientation adjusting agent to a silver plating solution; and electroplating a substrate in the silver plating solution, which contains the treated carbon particles and the silver matrix orientation adjusting agent, to form a coating of a composite material, which contains the treated carbon particles in a silver layer, on the substrate.

In this method for producing a composite plated product, the silver matrix orientation adjusting agent preferably contains selenium ions, and is more preferably potassium selenocyanate. The silver plating solution is preferably a cyanide containing silver plating solution.

According to another aspect of the present invention, a composite plated product comprises: a substrate; and a coating of a composite material containing carbon particles in a silver layer, the coating being formed on the substrate, wherein the content by weight of carbon in the coating is not less than 1.3% by weight, and the orientation plane of a silver matrix is (220) plane.

Preferably in this composite plated product, the quantity of the carbon particles on a surface of the coating is not less than 20% by area. The coating preferably has a thickness of 2 to 10 μm.

According to a further aspect of the present invention, an electric contact comprises: a stationary contact; and a movable contact for sliding on the stationary contact, wherein at least a part of at least one of the stationary and movable contacts contacting the other contact is made of the above described composite plated product.

According to a still further aspect of the present invention, there is provided a plating solution for forming a coating of a composite material, which contains carbon particles in a silver layer, on a substrate by electroplating, the plating solution comprising: a silver plating solution capable of plating a substrate with silver; carbon particles treated by an oxidation treatment to be added to the silver plating solution; and a silver matrix orientation adjusting agent, added to the silver plating solution, for adjusting an orientation of a silver matrix.

According to the present invention, it is possible to produce a composite plated product wherein a coating of a composite material containing carbon particles in a silver layer is formed on a substrate, the composite plated product having a large content of carbon and a large quantity of carbon particles on the surface thereof and having a low coefficient of friction and an excellent wear resistance. This composite plated product can be used as a material capable of sufficiently increasing the life of sliding contact parts such as switches and connectors.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

In a preferred embodiment of a method for producing a composite plated product according to the present invention, a coating of a composite material containing carbon particles in a silver layer is formed on a substrate by electroplating the substrate in a silver plating solution to which carbon particles treated by an oxidation treatment and a silver matrix orientation adjusting agent are added.

In the preferred embodiment of a method for producing a composite plated product according to the present invention, lipophilic organic substances absorbed onto the surface of carbon particles are removed by the oxidation treatment before the carbon particles are added to a silver plating solution. Such lipophilic organic substances include aliphatic hydrocarbons, such as alkanes and alkenes, and aromatic hydrocarbons, such as alkylbenzene.

As the oxidation treatment for carbon particles, a wet oxidation treatment, a dry oxidation treatment using oxygen gas or the like may be used. In view of mass production, a wet oxidation treatment is preferably used. If a wet oxidation treatment is used, it is possible to uniformly treat carbon particles having a large surface area.

Figure 1:
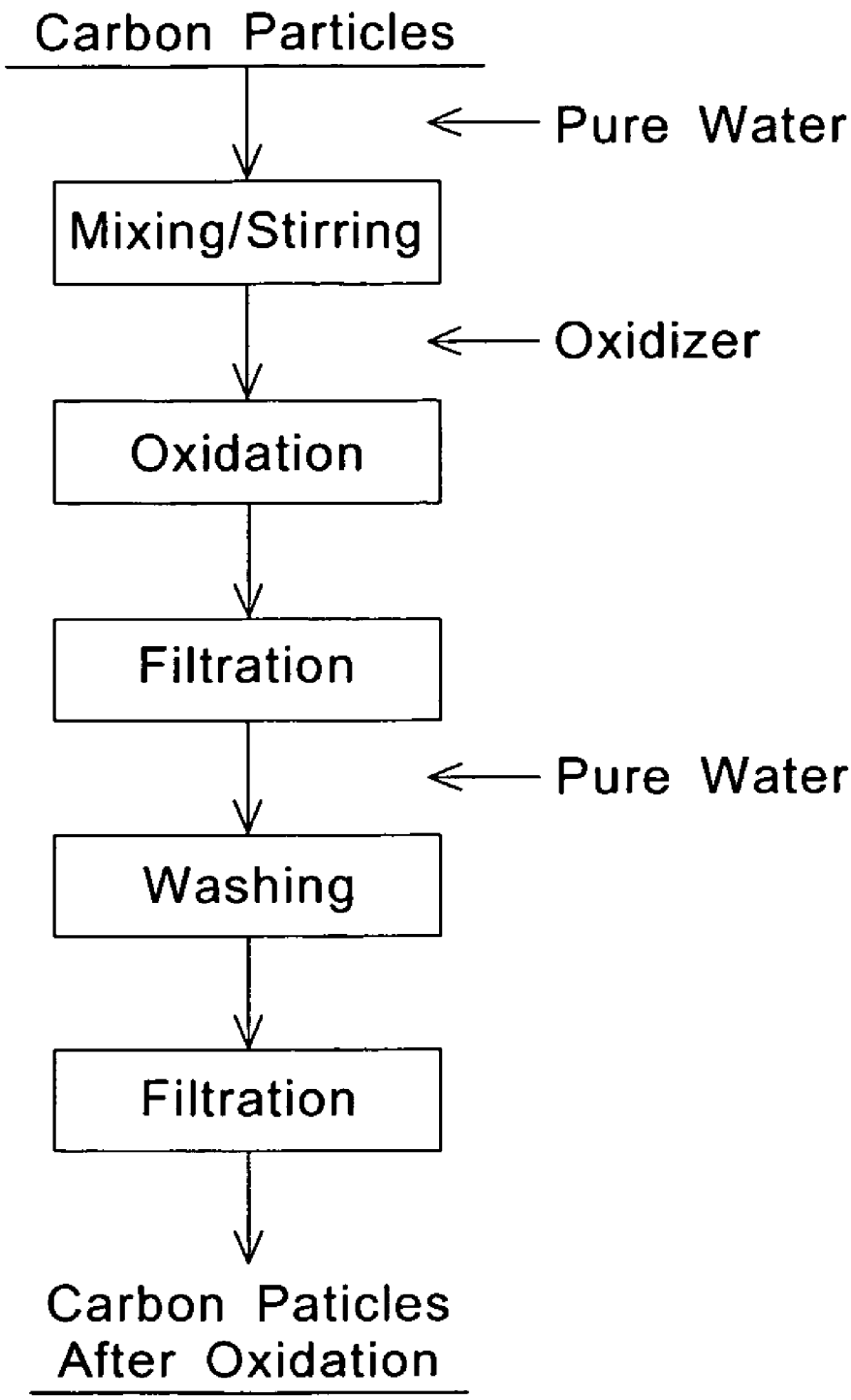
FIG. 1 is a flow chart showing a process for carrying out an oxidation treatment for carbon particles in a preferred embodiment of a method for producing a composite plated product according to the present invention.

As the wet oxidation treatment, there may be used a method for suspending carbon particles in an aqueous solution containing a conductive salt to put therein platinum electrodes or the like as a cathode and anode to carry out electrolysis, and a method for suspending carbon particles in water to add an optimum quantity of oxidizing agent thereto. In view of productivity, the latter is preferably used, and the quantity of carbon particles added to water is preferably in the range of from 1 wt % to 20 wt %. The oxidizing agent may be nitric acid, hydrogen peroxide, potassium permanganate, potassium persulfate, sodium perchlorate or the like. It is considered that the lipophilic organic substances adhering to carbon particles are oxidized by the added oxidizing agent so as to be soluble in water to be suitably removed from the surface of the carbon particles. If the carbon particles treated by the wet oxidation treatment are filtered and washed as shown in FIG. 1, it is possible to further enhance the function of removing the lipophilic organic substances from the surface of the carbon particles.

The lipophilic organic substances, such as aliphatic and aromatic hydrocarbons, can be thus removed from the surface of the carbon particles by the above described oxidation treatment. According to analysis based on gases heated at 300° C., gases generated by heating carbon particles to 300° C. after the oxidation treatment hardly contain lipophilic aliphatic hydrocarbons such as alkanes and alkens, and lipophilic aromatic hydrocarbons such as alkylbenzenes. Even if the carbon particles after the oxidation treatment slightly contain aliphatic and aromatic hydrocarbons, the carbon particles can be dispersed in a silver plating solution. However, the carbon particles do not preferably contain hydrocarbons having a molecular weight of 160 or more, and the intensity (the intensity in purge and gas chromatography and mass spectroscopy) of gases generated at 300° C. from hydrocarbons having a molecular weight of less than 160 in the carbon particles is preferably 5,000,000 or less. It is considered that, if the carbon particles contain hydrocarbons having a large molecular weight, the surface of each of the carbon particles is coated with strong lipophilic hydrocarbons, and the hydrocarbons are coagulated in the silver plating solution which is an aqueous solution, so that the carbon particles do not form a coating of a composite material.

When carbon particles, from which aliphatic and aromatic hydrocarbons are removed by the above described oxidation treatment, are suspended in the silver plating solution to carry out electroplating, a cyanide containing silver plating solution is preferably used as the silver plating solution. In the conventional methods, it is required to add a surface active agent to a cyanide containing silver solution if such a plating solution is used. However, in a preferred embodiment of a method for producing a composite plated product according to the present invention, it is not required to add any surface active agents to the silver plating solution, since it is possible to obtain a composite plating solution wherein carbon particles are uniformly dispersed in the silver plating solution even if no surface active agent is added thereto. Furthermore, the concentration of carbon particles in the silver plating solution is preferably in the range of from 40 g/l to 200 g/l. If it is less than 40 g/l, the content of carbon particles in the silver layer is considerably decreased, and if it exceeds 200 g/l, the viscosity of the silver plating solution is increased, so that it is difficult to agitate the silver plating solution.

If a cyanide containing silver plating solution is used, it is possible to obtain a composite coating which has a large content of carbon and a large quantity of carbon particles on the surface thereof. It is considered that the reason why the content of carbon in the coating is increased is that carbon particles are easily incorporated into a silver matrix since the silver plating solution does not contain any surface active agents to prevent the surface active agents from being absorbed onto the growth surface of a silver plating crystal when the crystal grows. It is also considered that the reason why the quantity of carbon particles on the surface of the coating is increased is that it is difficult for the carbon particles to be removed from the surface of the coating (similar to the cleaning function of detergent) during washing after plating, since the silver plating solution does not contain any surface active agents.

If carbon particles treated by the oxidation treatment are thus added to a silver plating solution, it is possible to sufficiently disperse the carbon particles in the silver plating solution without using any additives such as dispersing agents and without coating the surface of the carbon particles. In addition, if such a silver plating solution is used for carrying out electroplating, it is possible to produce a composite plated product wherein a coating of a composite material containing the carbon particles in a silver layer is formed on a substrate, the composite plated product having a large content of carbon and a large quantity of carbon particles on the surface thereof and having an excellent wear resistance.

In the preferred embodiment of a method for producing a composite plated product according to the present invention, a silver matrix orientation adjusting agent for adjusting the orientation of a silver matrix is added to the silver plating solution in addition to the carbon particles treated by the oxidation treatment. The silver matrix orientation adjusting agent preferably contains selenium (Se) ions, and is more preferably potassium selenocyanate (KSeCN). The concentration of the silver matrix orientation adjusting agent in the silver plating solution is preferably in the range of from 1 mg/l to 48 mg/l. If such a silver matrix orientation adjusting agent is added to the silver plating solution, the orientation of the silver matrix is considerably changed in accordance with the concentration of selenium ions. That is, the orientation plane of the silver matrix is (111) plane in conventional composite plated products coated with a composite material of silver and graphite particles. However, if the silver plating solution containing the silver matrix orientation adjusting agent is used, the orientation plane of the silver matrix is (220) plane. It is considered that the coating is formed of fine crystal grains, so that the characteristics of the coating are greatly changed by the direction of growth of crystal grains. It is also considered that, if the crystal orientation of carbon particles in the composite material and the orientation of crystal grains in the silver matrix are optimum, the silver matrix is easily deformed by friction and sliding, and the coefficient of friction is greatly decreased in cooperation with the lubricity of carbon particles, so that the wear resistance is improved.

It is considered that the composite coating of silver and carbon particles, wherein the orientation plane of a silver matrix is (220) plane, is formed by adding selenium ions to the silver plating solution containing carbon particles dispersed therein without adding any surface active agents. That is, in conventional composite coatings which contain graphite particles in the silver layer, a surface active agent is added to a silver plating solution in order to sufficiently disperse carbon particles therein. However, it is considered that the surface active agent is also absorbed onto the composite coating to have an influence on the direction of growth of the silver matrix, so that it is difficult to obtain a composite coating wherein the orientation plane of a silver matrix is (220) plane.

By thus forming the composite coating wherein the orientation plane of the silver matrix is (220) plane, the coefficient of friction of the composite coating can be lower. That is, if a silver plating solution containing a surface active agent is used as conventional methods, it is not possible to obtain a composite coating wherein the orientation plane of a silver matrix is (220) plane. Therefore, the coefficient of friction is higher than that in the preferred embodiment of a composite plated product according to the present invention, and the wear resistance thereof is lower than that in the preferred embodiment of a composite plated product according to the present invention.

By the above described preferred embodiment of a method for producing a composite plated product according the present invention, it is possible to produce a composite plated product wherein a coating of a composite material containing 1.3 wt % or more, preferably 1.5 to 2.2 wt %, of carbon particles in a silver layer is formed on a substrate, the quantity of the carbon particles on the surface thereof (the rate of carbon particles coating the substrate) being 10 area % or more, preferably 20 area % or more, and the orientation plane of a silver matrix being (220) plane. Furthermore, the wear resistance of the composite plated product is improved as the content of carbon in the coating is increased. In a composite plated product produced by the above described preferred embodiment of a method for producing a composite plated product according to the present invention, the content by weight of carbon in the coating can be 1.3 wt % or more, preferably 1.5 to 2.2 wt %, and the quantity of carbon particles on the surface of the coating can be 10 area % or more, preferably 20 area % or more, although the quantity of carbon particles on the surface of the coating is about 5 area % in conventional composite plated products of silver and graphite, so that it is possible to obtain a composite plated product having an excellent wear resistance. In addition, since the orientation plane of the silver matrix is (220) plane, it is possible to obtain a composite plated product having a coefficient of friction, which is greatly decreased in cooperation with the lubricity of carbon particles, and having an excellent wear resistance.

The thickness of the composite plated product is preferably in the range of from 2 μm to 10 μm. If the thickness of the composite plated product is less than 2 μm, the wear resistance is insufficient, and if it exceeds 10 μm, production efficiency is bad.

Figure 2:
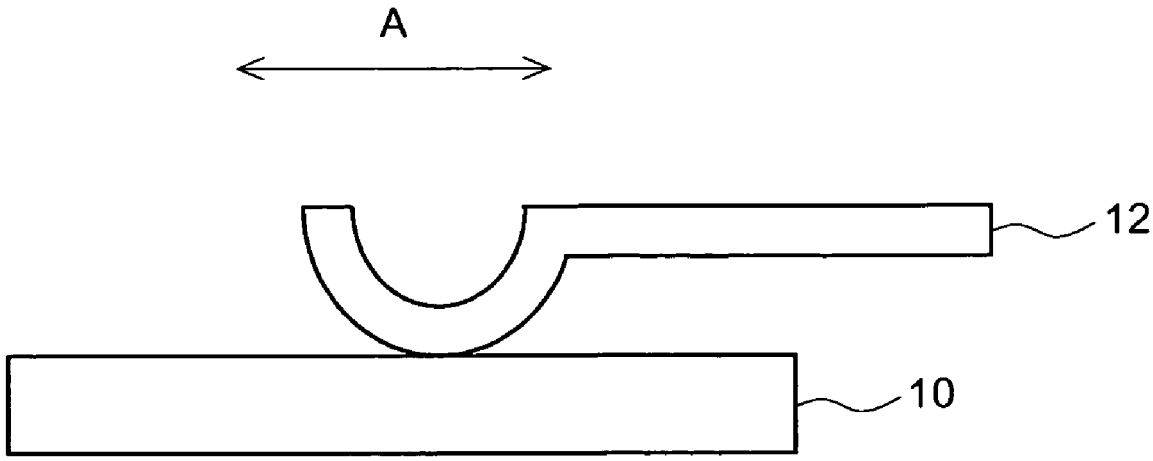
FIG. 2 is a schematic diagram for explaining an electric contact using a composite plated product according to the present invention.

In an electric contact comprising a stationary contact 10 and a movable contact 12 which is slidable on the stationary contact 10 in directions shown by arrow A in FIG. 2, if at least one of the stationary contact 10 and the movable contact 12 is formed of a composite plated product according to the present invention, the electric contact can have an excellent wear resistance. In this case, only a part of one of the stationary contact 10 and the movable contact 12 contacting the other contact may be formed of a composite plate product according to the present invention.

Examples of a composite plated product and a method for producing the same according to the present invention will be described below in detail.

Examples 1 Through 3

First, 6 wt % of scale-shaped graphite particles (Carbon SN-5 produced by SEC Corporation) having a mean particle diameter of 5 μm were prepared as carbon particles to be added to 3 L of pure water, and this mixed solution was heated to 50° C. while being stirred. Then, 1.2 L of a solution containing 0.1 mol/l of potassium persulfate was prepared as an oxidizing agent to be gradually dropped to the mixed solution, and then, stirred for two hours to carry out an oxidation treatment. Thereafter, filtration was carried out by means of a filter paper, and washing was carried out.

Figure 3:
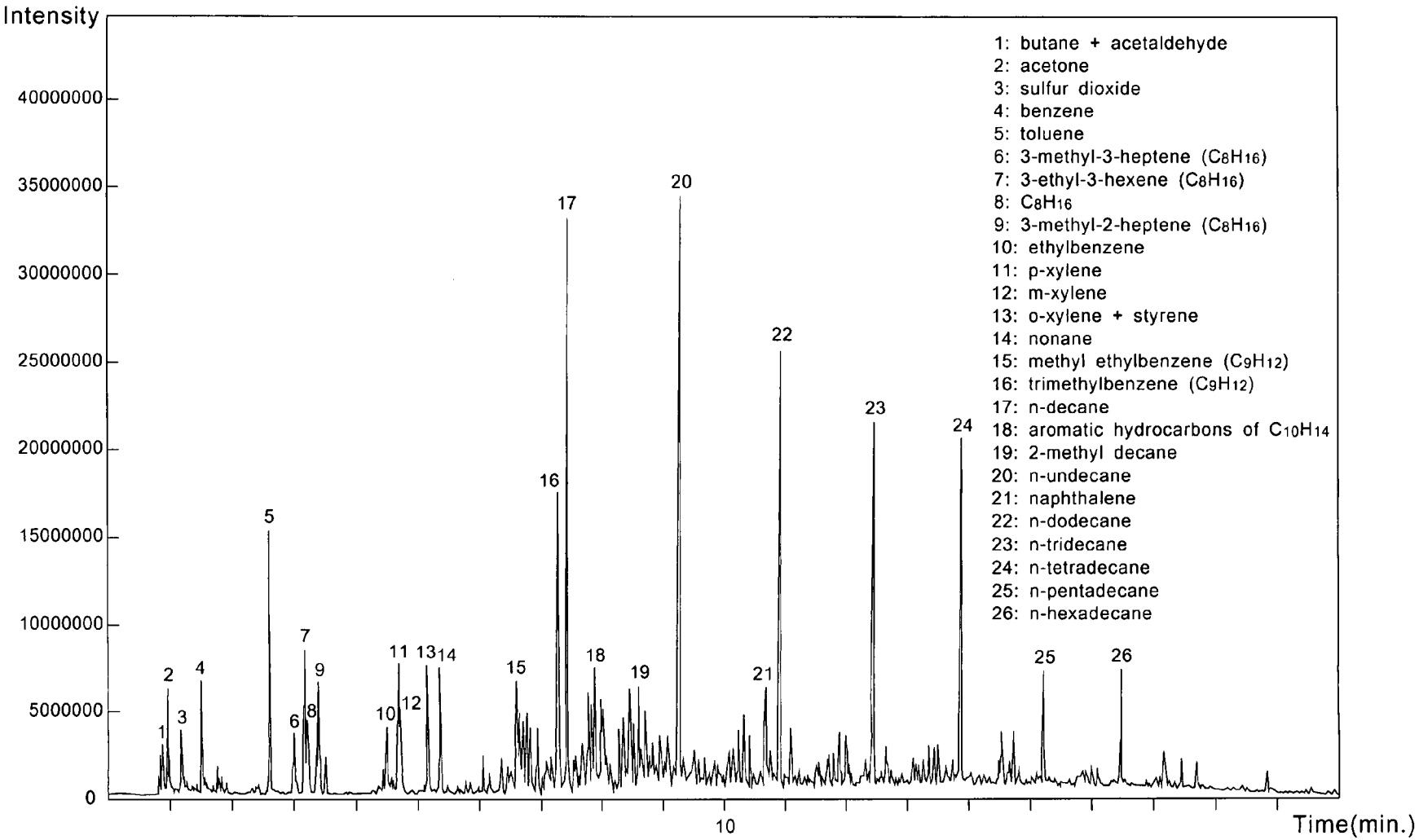
FIG. 3 is a graph showing the results of the analysis of gases generated from carbon particles at 300° C. before an oxidation treatment.
Figure 4:
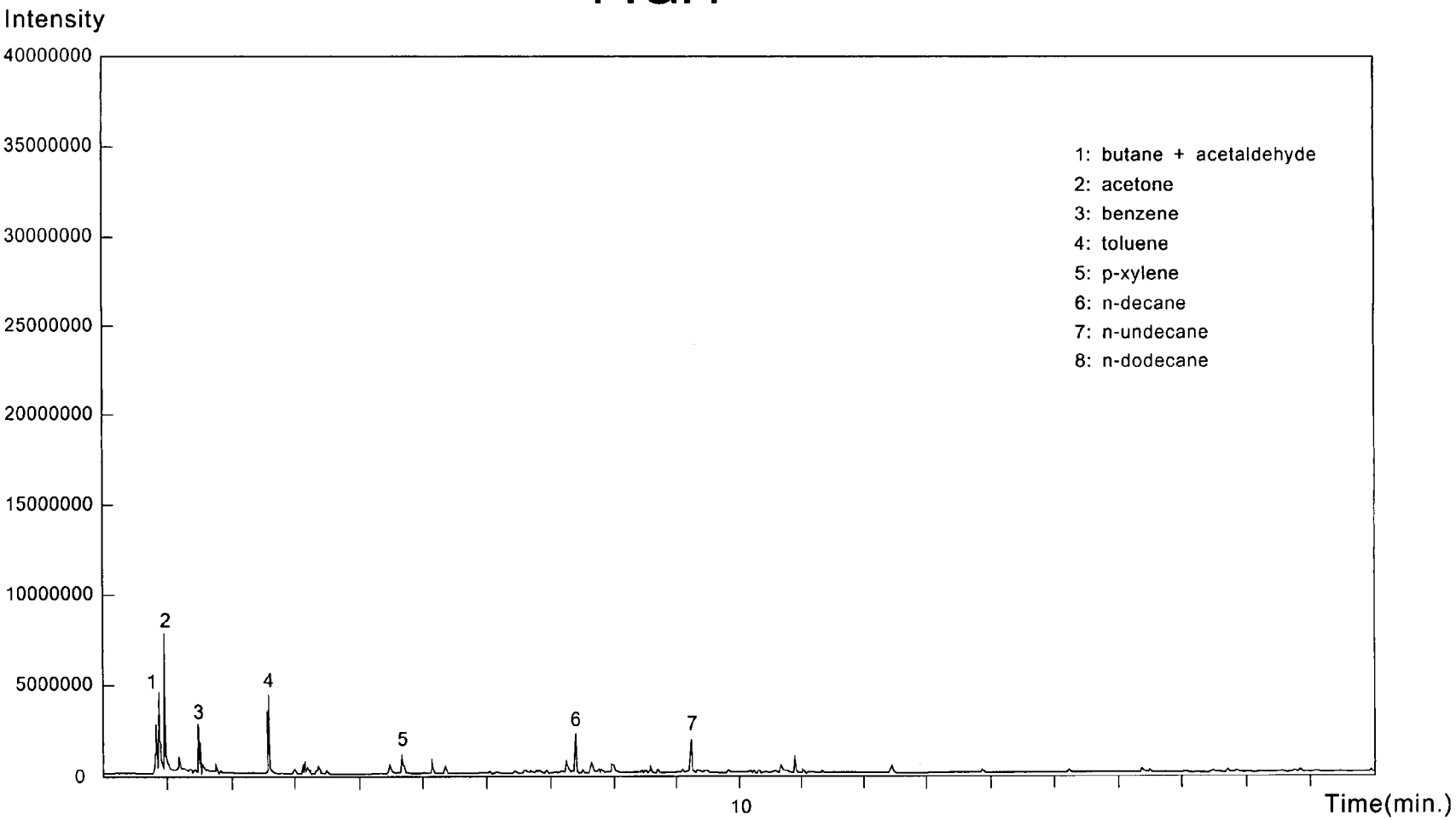
FIG. 4 is a graph showing the results of the analysis of gases generated from carbon particles at 300° C. after an oxidation treatment.

With respect to carbon particles before and after the oxidation treatment, gases generated at 300° C. were analyzed by means of a purge and gas chromatography and mass spectrometer (Japan Analysis Industry JHS-100) (GCMAS QP-5050A produced by Shimadzu Corp.) on conditions of purge and trap shown in Table 1 and on conditions of CGMS analysis shown in Table 2. The results are shown in Table 3, and the results of the analyses of carbon particles before and after the oxidation treatment are shown in FIGS. 3 and 4, respectively. As can be seen from Table 3 and FIGS. 3 and 4, lipophilic aliphatic hydrocarbons, such as nonane, decane and 3-methyl-2-hepten, and lipophilic aromatic hydrocarbons, such as xylene, were removed from the carbon particles by the above described oxidation treatment.

TABLE 1

| conditions of purge and trap | |
|---|---|
| purge temp. | 300° C. |
| purge time | 20 min. |
| trap temp. | −60° C. |
| absorbent | glass wool |
| thermal desorption temp. | 358° C. |
| thermal desorption time | 25 sec. |
| amount of sample | 200 mg |

TABLE 2

| conditions of GCMS analysis | |
|---|---|
| column | DB-5 ms 0.25 mm I.D. × 30 m |
| column temp. | 40° C. (3 min.) →10° C./min.→300° C. |
| inlet temp. | 300° C. |
| carrier | He 100 kPa |
| injecting method | split (1:30) |
| ionizing method | EI |
| detector gain | 1.70 kV |
| interface temp. | 250° C. |
| mass range | 20-900 m/z |

TABLE 3

| | kind | material name | molecular weight | peak intensity before oxidation | peak intensity after oxidation |
|---|---|---|---|---|---|
| AL | alkene | buten | 56.11 | 3144919 | 4607692 |
| | | 3-methyl-3-heptene | 112.21 | 3784837 | |
| | | 3-ethyl-3-hexene | 112.21 | 8545655 | |
| | | 3-methyl-2-heptene | 112.21 | 6635173 | |
| | alkane | nonane | 128.26 | 7517631 | |
| | | n-decane | 142.28 | 33201250 | 2247064 |
| | | n-undecane | 156.31 | 34487440 | 1960814 |
| | | n-dodecane | 170.33 | 25659890 | |
| | | n-tridecane | 184.36 | 21593880 | |
| | | n-tetradecane | 198.39 | 20702350 | |
| | | n-pentadecane | 212.42 | 7383416 | |
| | | n-hexadecane | 226.44 | 7460682 | |
| | | 2-methyldecane | 240.47 | 6486639 | |
| AR | benzene | benzene | 78.11 | 6774720 | 2834457 |
| | | toluene | 92.14 | 15352830 | 4401590 |
| | | ethylbenzene | 106.17 | 4157454 | |
| | | p-xylene | 106.17 | 7788405 | 1021066 |
| | | m-xylene | 106.17 | 5125236 | |
| | | o-xylene | 106.17 | 7625775 | |
| | | trimethyl benzene | 120.19 | 17572940 | |
| | | methylbenzene | 120.19 | 6787947 | |
| | | styrene | 104.15 | 7625775 | |
| | naphthalene | naphthalene | 128.17 | 6481065 | |
| | | $C_8H_{16}$ | 112.21 | 4510563 | |
| | | aromatic hydrocarbons of $C_{10}H_{14}$ | 134.22 | 7537705 | |
| O | ketone | acetaldehyde | 44.05 | 3144919 | 4607692 |
| | | acetone | 58.08 | 6291980 | 7838290 |
| R | | sulfur dioxide | | 3924202 | |
| | | air($N_2$, $CO_2$, $O_2$) | | 2526328 | 2857783 |

AL: aliphatic hydrocarbons
AR: aromatic hydrocarbons
O: containing oxygen
R: others Then, 80 g/l of carbon particles treated by the above described oxidation treatment were added to each of cyanide containing silver plating solutions comprising 120 g/l of potassium silver cyanide and 100 g/l of potassium cyanide to be dispersed and suspended therein, and 4 mg/l (Example 1), 8 mg/l (Example 2) and 48 mg/l (Example 3) of potassium selenocyanate (KSeCN) serving as a silver matrix orientation adjusting agent were added thereto, respectively, to prepare composite plating solutions of silver and carbon particles, respectively. Each of these composite plating solutions is used for electroplating a copper plate serving as a raw material having a thickness of 0.3 mm at a temperature of 25° C. and at a current density of 1 A/dm$^2$ to produce a composite plated product wherein a composite coating of silver and carbon particles having a thickness of 5 μm was formed on the copper plate. Furthermore, in order to improve the adhesion of the coating, silver strike plating was carried out as underlayer plating at a temperature of 25° C. and at a current density of 3 A/dm$^2$ in a silver strike plating bath containing 3 g/l of potassium silver cyanide and 100 g/l of potassium cyanide.

Samples were cut out of the composite plated product (containing the raw material) to be prepared for analyses of Ag and C, respectively. The content by weight (X wt %) of Ag in the sample was obtained by the plasma spectroscopic analysis by means of an ICP device (IRIS/AR produced by Jarrell Ash Corporation), and the content by weight (Y wt %) of C in the sample was obtained by the infrared analysis by means of a carbon/sulfur microanalyzer (EMIA-U510 produced by HORIBA, Ltd.). Then, the content by weight of C in the coating was calculated as Y/(X+Y). As a result, the content by weight of C in the coating was in the range of from 2.0% to 2.2% by weight. In addition, a cross section of the coating was observed by means of a scanning electron microscope (SEM). As a result, it was confirmed that the coating was formed of a composite material containing graphite particles dispersed in a silver layer.

The surface of a test piece cut out of each of the composite plated products was observed, and the quantity (% by area) of carbon particles on the surface of the coating was calculated as follows. First, an image of the surface of the test piece was taken as a super depth image at an objective lens power of 100 by means of a super depth shape microscope (VK-8500 produced by KEYENCE CORPORATION). Then, an image analyzing application (SCION IMAGE produced by SCION CORPORATION) was used on a personal computer for incorporating the image as a monochrome to indicate the contrast of the image as binary digits, so that the portions of silver were separated from the portions of carbon particles. Then, the quantity of carbon particles on the surface of the coating was calculated as a ratio Y/X of the number (Y) of pixels of the portions of carbon particles to the number (X) of pixels of the whole image. As a result, the quantity of carbon particles on the surface of the coating was 30 to 40 area % in Examples 1 through 3.

Then, the orientation of the silver matrix of a test piece cut out of each of the composite plated products was evaluated. In the evaluation of the orientation of the silver matrix, an X-ray diffractometer (XRD) (RAF-rB produced by RIGAKU Corporation) was used for measuring X-ray diffraction peaks, and the plane orientation of the strongest peak of the silver matrix was evaluated as the orientation of crystal of the coating. Furthermore, Cu-Kα was used as a vessel for measuring the X-ray diffraction peaks at 50 kV and 100 mA. In addition, a scintillation counter, a wide angle goniometer, and a curved crystal monochromator were used. The scanning range 2θ/θ was in the range of from 10° to 90°, and the step width was 0.05°. The scanning mode was FT, and the sampling time was 1.00 second. As a result, the orientation plane of the silver matrix was (220) plane in Examples 1 through 3.

Then, a cyanide containing silver plating solution comprising 120 g/l of potassium silver cyanide and 100 g/l of potassium cyanide was used as a plating solution for producing a silver-plated product wherein a silver coating having a thickness of 5 μm was formed on a copper plate having a thickness of 0.3 mm. Then, the coefficient of friction between the silver-plated product thus produced and the composite plated product was obtained. This coefficient of friction (μ) was calculated as follows. First, the test piece cut out of the composite plated product was indented (R=3 mm) to be used as a convex indenter, and the produced plate-shaped silver-plated product was used as an evaluating sample on the base side. A load cell was used for sliding the indenter on the evaluating sample at a moving speed of 60 mm/min while pushing the indenter against the evaluating sample at a load of 3 N, and a force (F) applied in horizontal directions was measured. Then, the coefficient of friction was calculated from μ=F/N. As a result, the coefficient of friction was 0.29 to 0.33 in Examples 1 through 3.

One of two test pieces cut out of each of the composite plated products thus obtained was intended (R=3 mm) to be used as an indenter, and the other test piece was used as an evaluating sample, so that the wear resistance of each of the composite plated products was evaluated by confirming the wearing state of each of the composite plated products by continuing the reciprocating sliding movement (sliding distance: 14 mm, sliding speed: 2 Hz) of the indenter while pushing the indenter against the evaluating sample at a constant load (0.5N) until the raw material was exposed. As a result, in Examples 1 through 3, the raw material was not exposed after the reciprocating sliding movement was repeated 500,000 times or more.

Examples 4 and 5

Composite plated products were produced by the same method as that in Example 1, except that the temperature of the solution during electroplating was 20° C. (Example 4) and 30° C. (Example 5), respectively. With respect to the composite plated products thus obtained, the content of carbon particles in the coating, the quantity (area %) of carbon particles on the surface of the coating, and the coefficient of friction thereof were calculated by the same methods as those in Examples 1 through 3, and the orientation of the silver matrix and the wear resistance thereof were evaluated by the same methods as those in Examples 1 through 3. As a result, in Examples 4 and 5, the content of carbon particles was 1.6 wt % and 1.8 wt %, respectively, and the quantity of carbon particles on the surface was 30 area % and 28 area %, respectively. In addition, the coefficient of friction was 0.32 and 0.33, respectively, and the orientation plane of the silver matrix was (220) plane. Moreover, the substrate was not exposed after the reciprocating sliding movement was repeated over 500,000 times.

Comparative Example 1

A composite plated product was produced by the same method as that in Example 1, except that the silver matrix orientation adjusting agent was not added to the plating solution. With respect to the composite plated product thus obtained, the content of carbon particles in the coating, the quantity (area %) of carbon particles on the surface of the coating, and the coefficient of friction thereof were calculated by the same methods as those in Examples 1 through 3, and the orientation of the silver matrix and the wear resistance thereof were evaluated by the same methods as those in Examples 1 through 3. As a result, the content of carbon particles was 0.8 wt %, and the quantity of carbon particles on the surface was 25 area %. In addition, the coefficient of friction was 0.41, and the orientation plane of the silver matrix was (111) plane. Moreover, the substrate was exposed after the reciprocating sliding movement was repeated below 40,000 times.

Comparative Example 2

A composite plated product was produced by the same method as that in Comparative Example 1, except that the oxidation treatment for carbon particles was not carried out. With respect to the composite plated product thus obtained, the content of carbon particles in the coating, the quantity (area %) of carbon particles on the surface of the coating, and the coefficient of friction thereof were calculated by the same methods as those in Examples 1 through 3, and the orientation of the silver matrix and the wear resistance thereof were evaluated by the same methods as those in Examples 1 through 3. As a result, the content of carbon particles was 0 wt %, and the quantity of carbon particles on the surface was 0 area %, so that carbon particles were not contained in the coating. In addition, the coefficient of friction was 1.2 which was far higher than that in Examples 1 through 3. Moreover, the orientation plane of the silver matrix was (111) plane, and the substrate was exposed after the reciprocating sliding movement was repeated below 5,000 times.

Furthermore, as can be seen from the results of the analysis of gases generated at 300° C. as shown in Table 3 and FIG. 3, if the oxidation treatment is not carried out as this comparative example, a large number of peaks exhibiting lipophilic aliphatic and aromatic hydrocarbons appear so that lipophilic aliphatic and aromatic hydrocarbons adhere to graphite particles. In addition, if graphite particles were not treated by the oxidation treatment as this comparative example, the graphite particles were coagulated in the plating solution, so that it was not possible to uniformly suspend the graphite particles therein.

Comparative Example 3

A composite plated product was produced by the same method as that in Comparative Example 2, except that sodium dodecylbenzenesulfonate having a high function of dispersing carbon particles was added to the plating solution as a surface active agent. With respect to the composite plated product thus obtained, the content of carbon particles in the coating, the quantity (area %) of carbon particles on the surface of the coating, and the coefficient of friction thereof were calculated by the same methods as those in Examples 1 through 3, and the orientation of the silver matrix and the wear resistance thereof were evaluated by the same methods as those in Examples 1 through 3. As a result, the content of carbon particles was 1.1 wt %, and the quantity of carbon particles on the surface was 5 area %, so that they were smaller than those in Examples 1 through 3. In addition, the coefficient of friction was 0.50 which was higher than that in Examples 1 through 3. Moreover, the orientation plane of the silver matrix was (111) plane, and the substrate was exposed after the reciprocating sliding movement was repeated below 40,000 times.

The results in Examples 1 through 5 and Comparative Examples 1 through 3 are shown in Table 4.

TABLE 4

| | O | S | CD | Se | T | CC | QC | CO | CF | WR |
|---|---|---|---|---|---|---|---|---|---|---|
| Ex. 1 | X | — | 1 | 4 | 25 | 2.2 | 40 | 220 | 0.30 | over 500,000 |
| Ex. 2 | X | — | 1 | 8 | 25 | 2.2 | 38 | 220 | 0.31 | over 500,000 |
| Ex. 3 | X | — | 1 | 48 | 25 | 2.0 | 30 | 220 | 0.29 | over 500,000 |
| Ex. 4 | X | — | 1 | 4 | 20 | 1.8 | 30 | 220 | 0.32 | over 500,000 |
| Ex. 5 | X | — | 1 | 4 | 30 | 1.6 | 28 | 220 | 0.33 | over 500,000 |
| Comp. 1 | X | — | 1 | 0 | 25 | 0.8 | 25 | 111 | 0.41 | below 40,000 |
| Comp. 2 | — | — | 1 | 0 | 25 | 0 | 0 | 111 | 1.23 | below 5,000 |
| Comp. 3 | — | X | 1 | 0 | 25 | 1.1 | 5 | 111 | 0.50 | below 40,000 |

O: oxidation treatment
S: surface active agent
CD: current density ($A/dm^2$)
Se: concentration of KSeCN
T: temperature (° C.)
CC: content (% by weight) of carbon
QC: quantity (% by area) of carbon particles on surface
CO: crystal orientation
CF: coefficient of friction
WR: wear resistance While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A method for producing a composite plated product, the method comprising the steps of:

preparing carbon particles and a silver matrix orientation adjusting agent which is an agent for adjusting the orientation of a silver matrix, said silver matrix orientation adjusting agent containing selenium ions;

treating said carbon particles by an oxidation treatment for removing lipophilic organic substances from the carbon particles;

adding the treated carbon particles and said silver matrix orientation adjusting agent to a cyanide containing silver plating solution to disperse and suspend the treated carbon particles therein to prepare a composite plating solution of silver and the treated carbon particles; and electroplating a substrate in the composite plating solution, which contains the treated carbon particles and the silver matrix orientation adjusting agent, to form a coating of a composite material, which contains the treated carbon particles in a silver layer, on the substrate.

2. A method for producing a composite plated product as set forth in claim 1, wherein said silver matrix orientation adjusting agent is potassium selenocyanate.

* * * * *